US008102354B2

(12) United States Patent
Jung

(10) Patent No.: US 8,102,354 B2
(45) Date of Patent: Jan. 24, 2012

(54) DATA DRIVER AND LIQUID CRYSTAL DISPLAY USING THE SAME

(75) Inventor: Tae Woo Jung, Ulsan-Si (KR)

(73) Assignee: LG Display Co., Ltd., Seoul (KR)

( * ) Notice: Subject to any disclaimer, the term of this patent is extended or adjusted under 35 U.S.C. 154(b) by 893 days.

(21) Appl. No.: 11/431,573

(22) Filed: May 11, 2006

(65) Prior Publication Data

US 2006/0256065 A1 Nov. 16, 2006

(30) Foreign Application Priority Data

May 12, 2005 (KR) ..... 10-2005-0039729

(51) Int. Cl.
*G09G 3/36* (2006.01)

(52) U.S. Cl. ..... 345/100

(58) Field of Classification Search ..... None
See application file for complete search history.

(56) References Cited

U.S. PATENT DOCUMENTS 6,806,853 B2 * 10/2004 Park et al. ..... 345/82
7,023,458 B2 * 4/2006 Kudo et al. ..... 345/690
2002/0163490 A1 11/2002 Nose ..... 345/89
2002/0186230 A1 12/2002 Kudo et al.
2003/0071778 A1 * 4/2003 Lee et al. ..... 345/98
2003/0085865 A1 5/2003 Lee et al.
2004/0066381 A1 * 4/2004 Lin et al. ..... 345/204

FOREIGN PATENT DOCUMENTS

KR 2002-0093614 A 12/2002
KR 2003-0038315 A 5/2003

OTHER PUBLICATIONS

Korean Office Action dated May 24, 2011.
German Office Action dated Jun. 29, 2011.

* cited by examiner

*Primary Examiner* — Tammy Pham
(74) *Attorney, Agent, or Firm* — Morgan, Lewis & Bockius LLP

(57) ABSTRACT

A data driver includes a gamma voltage generator that generates red, green, and blue gamma voltages according to red, green, and blue adjustment signals, and a digital to analog converter that converts data signals received from a latch to positive or negative analog video signals using the red, green, and blue gamma voltages received from the gamma voltage generator.

2 Claims, 6 Drawing Sheets

DATA DRIVER AND LIQUID CRYSTAL DISPLAY USING THE SAME

This application claims the benefit of the Korean Patent Application No. 2005-039729, filed on May 12, 2005, which is hereby incorporated by reference in its entirety.

BACKGROUND OF THE INVENTION

1. Field of the Invention

The present invention relates to a liquid crystal display, and more particularly, to a data driver and a liquid crystal display using the same which can improve the image quality. Although the present invention is suitable for a wide scope of applications, it is particularly suitable for adjusting chromaticity in a liquid crystal display.

2. Discussion of the Related Art

In general, a liquid crystal display (LCD) generates images by controlling light transmittance of liquid crystal cells according to video signals. An active matrix liquid crystal display, which includes switching elements formed respectively in liquid crystal cells, is suitable to display moving images. Thin film transistors (TFT) are typically used as the switching elements in the active matrix liquid crystal display.

FIG. 1 shows a schematic diagram of an apparatus for driving an LCD according to the related art. As shown in FIG. 1, the related art apparatus for driving an LCD includes an image display unit 10, a data driver 20, a gate driver 30, and a timing controller 40. The image display unit 10 includes liquid crystal cells formed in areas defined by gate lines GL1 to GLn crossing data lines DL1 to DLm. The data driver 20 supplies analog video signals to the data lines DL1 to DLm. The gate driver 30 supplies scan pulses to the gate lines GL1 to GLn. The timing controller 40 aligns externally provided source data RGB to supply aligned data to the data driver 20, generates data control signals DCS to control the data driver 20, and generates gate control signals GCS to control the gate driver 30.

The image display unit 10 includes a transistor array substrate (not shown) and a color filter array substrate (not shown) that are affixed together. Spacers (not shown) maintain a cell gap between the two array substrates, and a liquid crystal (not shown) is filled into the gap provided by the spacers. Liquid crystal cells are formed respectively in areas defined by the n-th gate lines GL1 to GLn crossing the m-th data lines DL1 to DLm. Thin film transistors (TFTs) are connected the n-th gate lines GL1 to GLn and the m-th data lines DL1 to DLm in each of the liquid crystal cells. In response to scan pulses from the gate lines GL1 to GLn, the TFTs provide data signals from the data lines DL1 to DLm to the liquid crystal cells. Each of the liquid crystal cells includes a pixel electrode connected to a corresponding TFT and a common electrode, which face each other with a liquid crystal therebetween. Thus, each liquid crystal cell can be equivalently expressed as a liquid crystal capacitor Clc. Each liquid crystal cell also includes a storage capacitor Cst that is connected to a previous gate line to maintain a data signal with which the liquid crystal capacitor Clc is charged until the liquid crystal capacitor Clc is charged with a next data signal.

The timing controller 40 arranges source data RGB input from the outside so as to be suitable to drive the image display unit 10 and provides such arranged source data RGB to the data driver 20. Using a main clock MCLK, a data enable signal DE, and horizontal and vertical synchronization signals Hsync and Vsync, the timing controller 40 generates a data control signal DCS and a gate control signal GCS to control the drive timings of the data driver 20 and the gate driver 30.

The gate driver 30 includes a shift register that sequentially generates scan pulses (i.e., high gate pulses) in response to a gate start pulse GSP and a gate shift clock GSC included in the gate control signal GCS from the timing controller 40. The gate driver 30 sequentially provides the high gate pulses to gate lines GL1 to GLn in the image display unit 10 to turn on TFTs connected to the gate lines GL1 to GLn.

The data driver 20 converts the arranged data signals Data from the timing controller 40 to analog video signals corresponding to the data control signal DCS received from the timing controller 40. The data driver 20 provides the analog video signals, corresponding to a single horizontal line, to the data lines DL1 to DLm every horizontal period during which a single scan pulse is provided. In response to a polarity control signal POL, the data driver 20 reverses the polarity of the analog video signals provided to the data line DL1 to DLm on a line by line basis.

FIG. 2 is a block diagram of the data driver shown in FIG. 1. As shown in FIG. 2, the data driver 20 includes a shift register 21, a first latch 22, a second latch 23, a gamma voltage generator 24, and a digital to analog converter (DAC) 26. The shift register 21 generates sampling signals using a source shift clock SSC and a source start pulse SSP included in the data control signal DCS from the timing controller 40. Specifically, the shift register 21 generates sampling signals by shifting the source start pulse SSP in response to the source shift clock SSC and sequentially provides the sampling signals to the first latch 22. The first latch 22 sequentially samples the arranged data signals Data received from the timing controller 40 in response to the sampling signals from the shift register 21 and provides the sampled data signals to the second latch 23. The second latch 23 stores the sampled data signals received from the first latch 22 on a line by line basis and simultaneously outputs the stored data signals, corresponding to a single line, to the DAC 26 in synchronization with a source output enable signal SOE included in the data control signal DCS.

FIGS. 3A and 3B illustrate the gamma voltage generator shown in FIG. 2. The gamma voltage generator 24 generates a plurality of positive gamma voltages Pgma and a plurality of negative (−) gamma voltages Ngma at voltage divider nodes between a plurality of resistors connected in series between first and second voltages VH and VL and provides the positive and negative gamma voltages Pgma and Ngma to the DAC 26. To generate these voltages, the gamma voltage generator 24 includes a positive gamma voltage generator 24P as shown in FIG. 3A, which generates a plurality of positive gamma voltages Pgma, and a negative gamma voltage generator 24N as shown in FIG. 3B, which generates a plurality of negative (−) gamma voltages Ngma.

As shown in FIG. 3A, the positive gamma voltage generator 24P includes a positive resistor set 50P, a positive decoder 52P, and a positive gray amplifier 54P. The positive resistor set 50P includes a plurality of resistors connected in series between the first and second voltages VH and VL and outputs n positive divided voltages PV1 to PVn using the resistors connected in series. The positive decoder 52P decodes the n divided voltages PV1 to PVn received from the positive resistor set 50P and outputs m positive reference gamma voltages PVref1 to PVrefm. The positive gray amplifier 54P generates a plurality of positive gamma voltage Pgma using the m positive reference gamma voltages PVref1 to PVrefm output from the positive decoder 52P.

The positive resistor set 50P includes a plurality of resistors connected in series between a first voltage VH and a second voltage VL lower than the first voltage VH. The positive resistor set 50P provides a plurality of different positive divided voltages PV1 to PVn, generated at the voltage divider nodes between the resistors through voltage division corresponding to resistances of the resistors, to the positive decoder 52P. The positive resistor set 50P adjusts the resistances of the resistors in response to a curve adjustment signal GAS and an amplitude adjustment signal AAS received from the outside, thereby adjusting a gamma curve and a gamma voltage amplitude.

The positive decoder 52P decodes a plurality of positive divided voltages PV1 to PVn received from the positive resistor set 50P in response to a fine adjustment signal FAS received from the outside and generates m positive reference gamma voltages PVref1 to PVrefm. To accomplish this, the positive decoder 52P includes a plurality of decoders that generates m-2 positive reference gamma voltages PVref2 to PVrefm-1 except the highest and lowest positive reference gamma voltages PVref1 and PVrefm.

The positive gray amplifier 54P further divides m positive reference gamma voltages PVref1 to PVrefm received from the positive decoder 52P and generates a plurality of positive gamma voltages Pgma corresponding to gray levels of the data signals Data to be provided to the data driver 20. The positive gray amplifier 54P provides the positive gamma voltages Pgma to the DAC 26, as shown in FIG. 2.

As shown in FIG. 3B, the negative gamma voltage generator 24N includes a negative resistor set 50N, a negative decoder 52N, and a negative gray amplifier 54N. The negative resistor set 50N includes a plurality of resistors connected in series between the first and second voltages VH and VL and outputs n negative divided voltages NV1 to NVn using the resistors connected in series. The negative decoder 52N decodes the n divided voltages NV1 to NVn received from the negative resistor set 50N and outputs m negative reference gamma voltages NVref1 to NVrefm. The negative gray amplifier 54N generates a plurality of negative gamma voltage Ngma using the m negative reference gamma voltages NVref1 to NVrefm output from the negative decoder 52N.

The negative resistor set 50N includes a plurality of resistors connected in series between a first voltage VH and a second voltage VL lower than the first voltage VH. The negative resistor set 50N provides a plurality of different negative divided voltages NV1 to NVn, generated at the voltage divider nodes between the resistors through voltage division corresponding to resistances of the resistors, to the negative decoder 52N. The negative resistor set 50N adjusts the resistances of the resistors in response to a curve adjustment signal GAS and an amplitude adjustment signal AAS received from the outside, thereby adjusting the gamma curve and the gamma voltage amplitude.

The negative decoder 52N decodes a plurality of negative divided voltages NV1 to NVn received from the negative resistor set 50N in response to a fine adjustment signal FAS received from the outside and generates m negative reference gamma voltages NVref1 to NVrefm. To accomplish this, the negative decoder 52N includes a plurality of decoders that generates m-2 negative reference gamma voltages NVref2 to NVrefm-1 except the highest and lowest negative reference gamma voltages NVref1 and NVrefm.

The negative gray amplifier 54N further divides m negative reference gamma voltages NVref1 to NVrefm received from the negative decoder 52N and generates a plurality of negative gamma voltages Ngma corresponding to gray levels of the data signals Data to be provided to the data driver 20. The negative gray amplifier 54N provides the negative gamma voltages Ngma to the DAC 26, as shown in FIG. 2.

Using a plurality of positive gamma voltages Pgma and a plurality of negative gamma voltages Ngma received from the gamma voltage generator 24, the DAC 26 converts data signals received from the second latch 23 to positive or negative analog video signals. The DAC 26 simultaneously outputs the analog video signals, corresponding to a single line, to the data lines DL1 to DLm. The DAC 26 generates positive or negative video signals in response to a polarity control signal POL included in the data control signal DCS from the timing controller 40.

As described above, the related art data driver 20 performs digital to analog conversion using positive and negative gamma voltages Pgma and Ngma produced by a single positive resistor set 50P and a single negative resistor set 50N.

In the meantime, red R, green G, and blue B color filters are manufactured corresponding to chromaticity coordinates of red, green, and blue colors for the related art liquid crystal display. However, the related art liquid crystal display uses the same gamma voltage for the red, green, and blue liquid crystal cells despite that these cells have different electro-optical characteristics. Thus, the related art liquid crystal display cannot accomplish individual gamma voltages of red, green, and blue colors and cannot adjust individual chromaticity coordinates of red, green, and blue colors. In addition, R, G, and B color characteristics may vary slightly due to small variations in the common voltage during line-inversion operation of the image display unit 10 in the related art liquid crystal display, thereby reducing the image quality. Further, both the positive and negative gamma voltages Pgma and Ngma are provided to the DAC 26 in the related art liquid crystal display, thereby complicating the structure of the DAC 26 and increasing the size thereof.

SUMMARY OF THE INVENTION

Accordingly, the present invention is directed to a data driver and a liquid crystal display using the same that substantially obviate one or more problems due to limitations and disadvantages of the related art.

An object of the present invention is to provide a data driver and a liquid crystal display using the same with improved image quality.

Another object of the present invention is to provide a data driver and a liquid crystal display using the same which can simplify the structure of a DA converter included in the data driver and reduce the size thereof.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a data driver includes: a gamma voltage generator that generates red, green, and blue gamma voltages according to red, green, and blue adjustment signals; and a digital to analog converter that converts the data signals received from a latch to positive or negative analog video signals using the red, green, and blue positive gamma voltages or red, green, and blue negative gamma voltages received from the gamma voltage generator.

In another aspect, a data driver includes: a shift register that generates sampling signals using a shift clock and a start pulse; a latch that sequentially samples data signals, received from the outside, in response to the sampling signals; a gamma voltage generator that generates red, green, and blue positive gamma voltages and red, green, and blue negative gamma voltages and selectively outputs the red, green, and blue positive gamma voltages or the red, green, and blue negative gamma voltages according to a polarity control signal; and a digital to analog converter that converts the data signals received from the latch to positive or negative analog video signals using the red, green, and blue positive gamma voltages or the red, green, and blue negative gamma voltages received from the gamma voltage generator.

In another aspect, a liquid crystal display includes: an image display unit that displays images by controlling light transmittance of liquid crystal cells provided in areas defined by gate and data lines crossing each other; a gate driver supplying scan pulses to the gate lines; a data driver supplying positive or negative analog video signals to the data lines; and a timing controller supplying data signals to the data driver and controls drive timings of the data driver and the gate driver, wherein the data driver includes: a shift register that generates sampling signals using a shift clock and a start pulse; a latch that sequentially samples the data signals, received from the timing controller, according to the sampling signals; an gamma voltage generator that generates red, green, and blue positive gamma voltages and red, green, and blue negative gamma voltages and selectively outputs the red, green, and blue positive gamma voltages or red, green, and blue negative gamma voltages according to a polarity control signal; and a digital to analog converter that converts the sampled data signals received from the latch to the positive or negative analog video signals using the red, green, and blue positive gamma voltages or the red, green, and the blue negative gamma voltages received from the gamma voltage generator.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
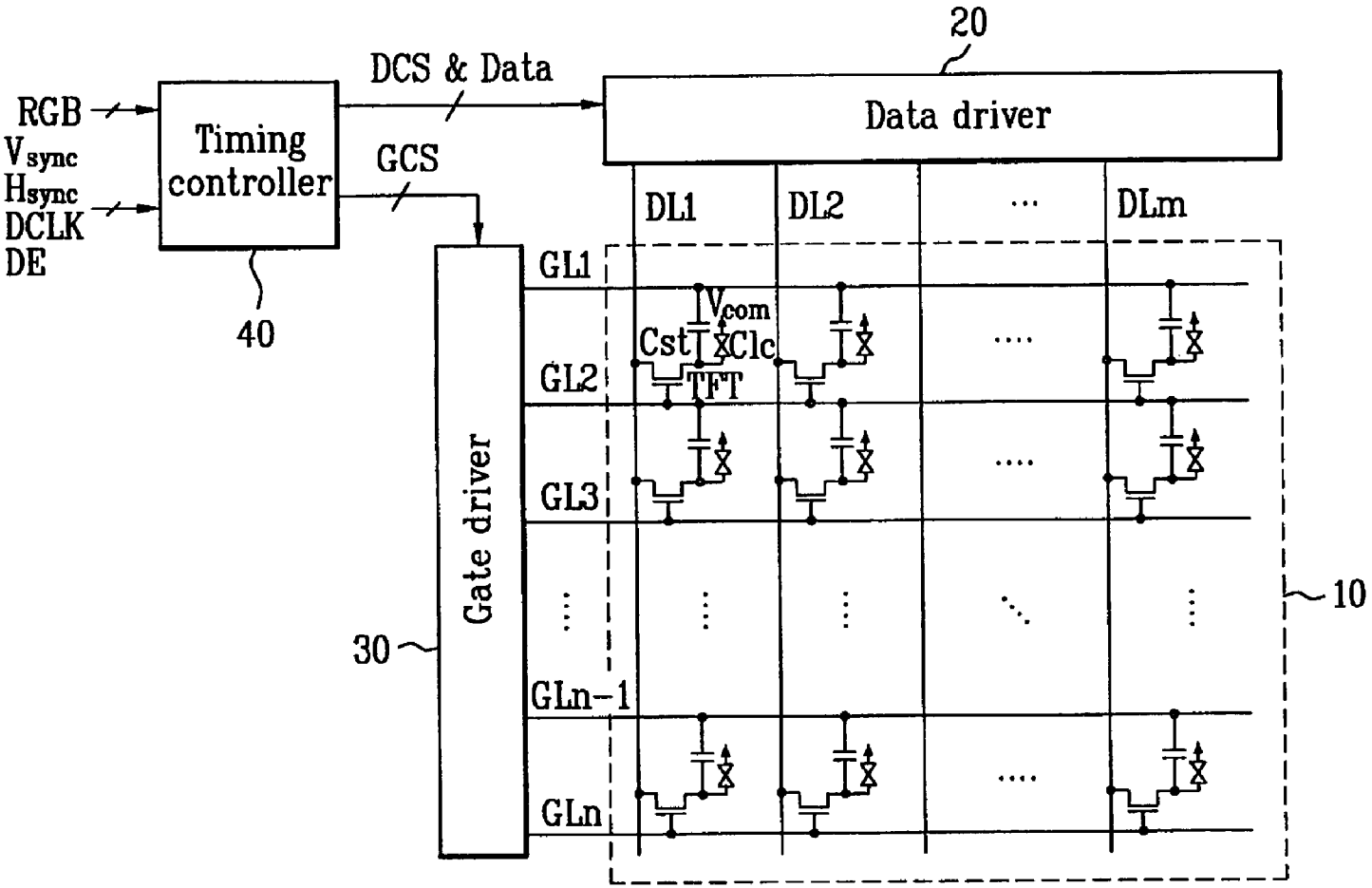
FIG. 1 Related Art
FIG. 1 shows a schematic diagram of an apparatus for driving an LCD according to the related art.
Figure 2:
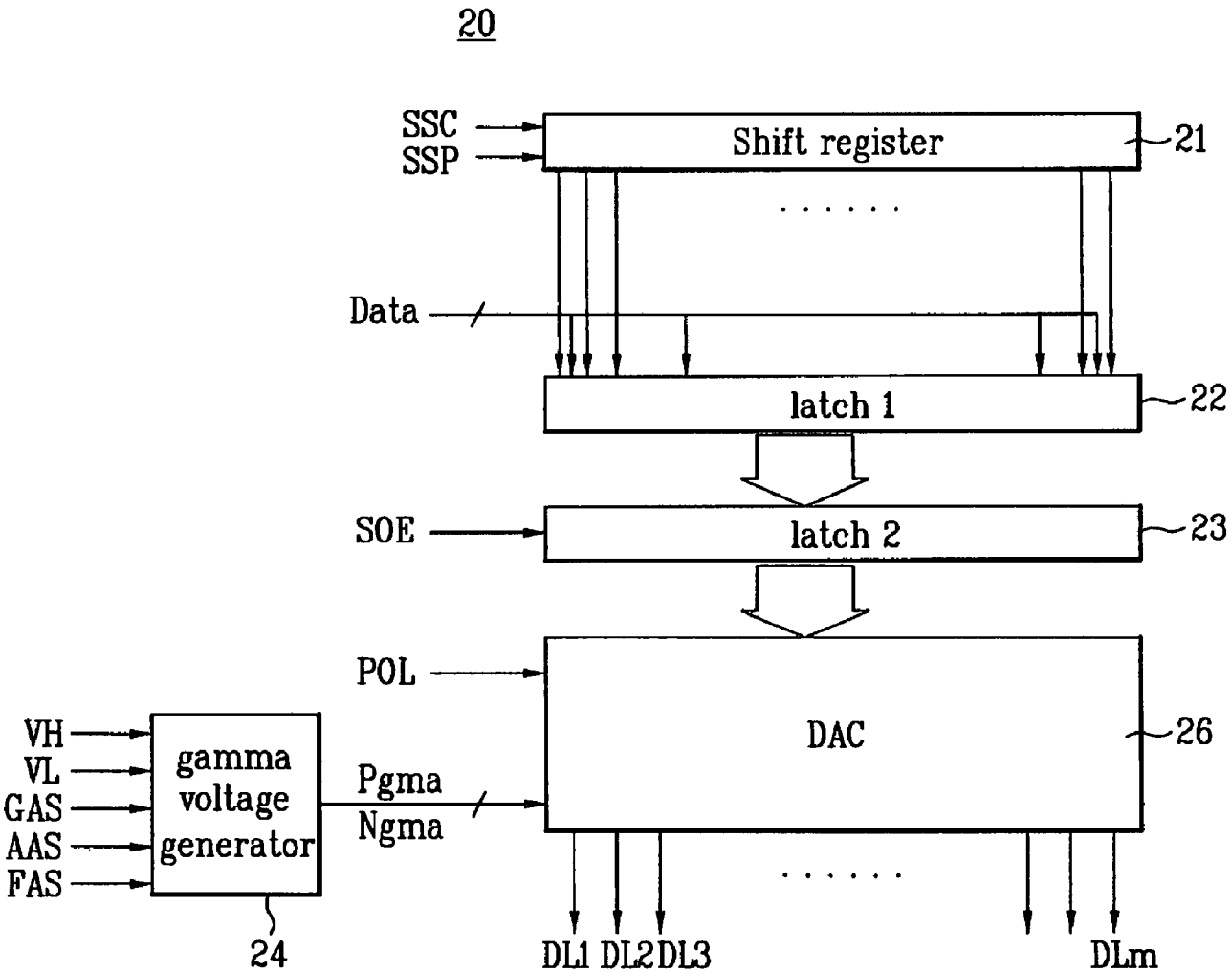
FIG. 2 Related Art
FIG. 2 is a block diagram of the data driver shown in FIG. 1.
Figure 3A:
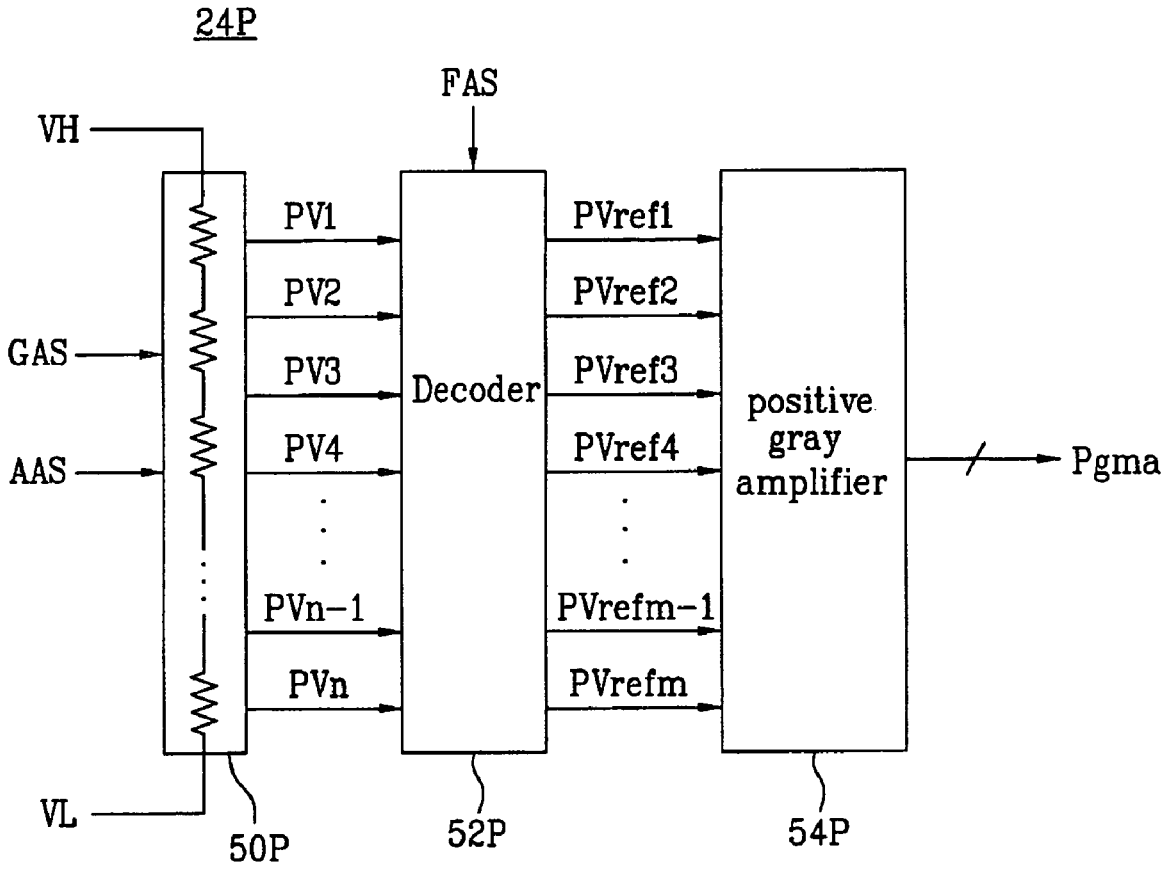
FIG. 3A Related Art
FIGS. 3A and 3B illustrate the gamma voltage generator shown in FIG. 2.
Figure 3B:
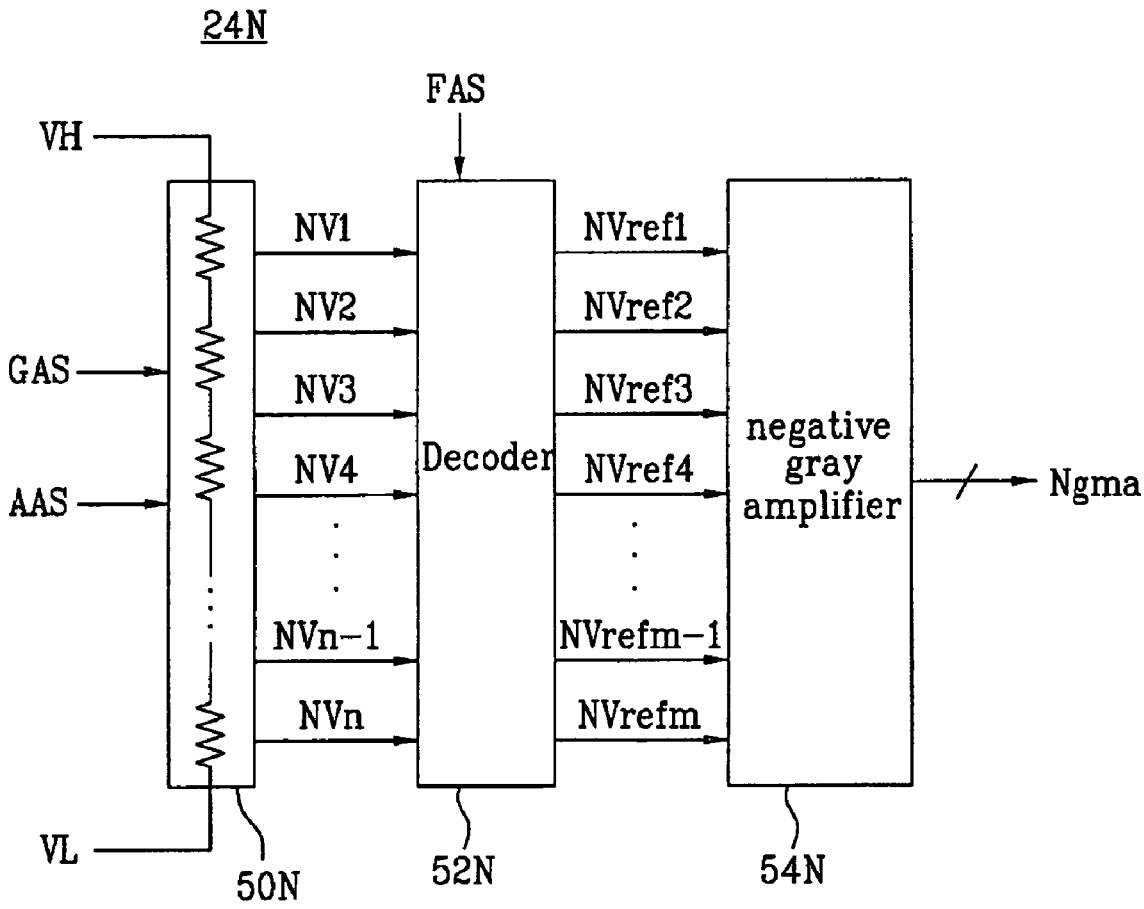
Figure 4:
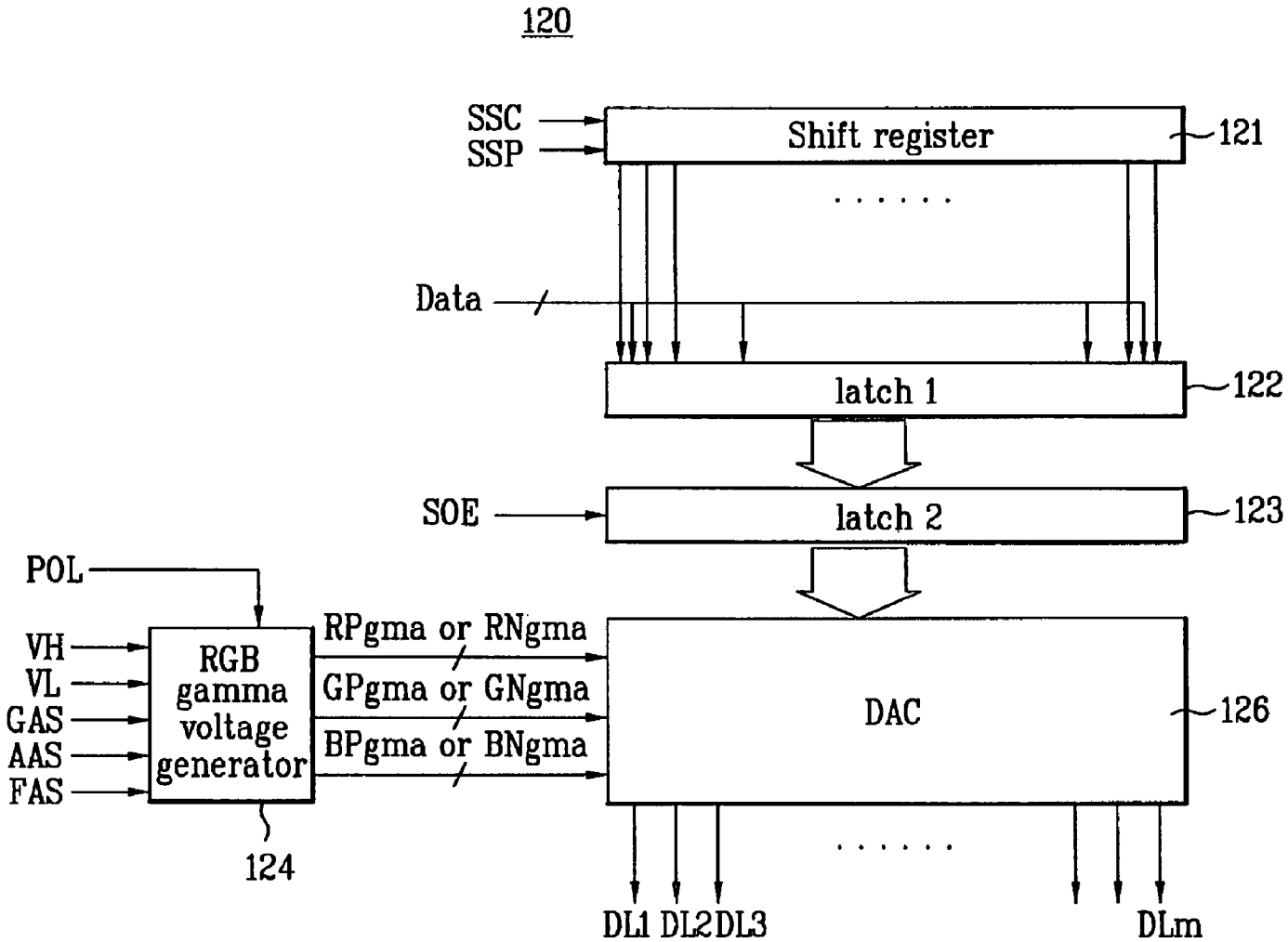
FIG. 4 is a block diagram of a data driver according to an embodiment of the present invention.

FIG. 4 is a block diagram of a data driver in a liquid crystal display according to an embodiment of the present invention. Components, other than the data driver, of the liquid crystal display in the embodiment of the present invention are similar to those of the conventional liquid crystal display shown in FIG. 1. Thus, a description of the components, other than the data driver, of the liquid crystal display in the embodiment of the present invention is replaced with the description of those of the related art liquid crystal display shown in FIG. 1.

As shown in FIG. 4, the data driver 120 according to the embodiment of the present invention includes a shift register 121, a first latch 122, a second latch 123, an RGB gamma voltage generator 124, and a digital to analog converter (DAC) 126. The shift register 121 generates sampling signals using a source shift clock SSC and a source start pulse SSP. The first latch 122 sequentially samples data signals Data input from the outside in response to the sampling signals. The second latch 123 simultaneously outputs the data signals sampled by the first latch 122, which correspond to a single line, according to a source output enable signal SOE. The RGB gamma voltage generator 124 generates RGB positive gamma voltages (RPgma, GPgma, and BPgma) and RGB negative gamma voltages (RNgma, GNgma, and BNgma) and selectively outputs the RGB positive gamma voltages (RPgma, GPgma, and BPgma) or the RGB negative gamma voltages (RNgma, GNgma, and BNgma) according to a polarity control signal POL. Using the RGB positive gamma voltages (RPgma, GPgma, and BPgma) or the RGB negative gamma voltages (RNgma, GNgma, and BNgma) from the RGB gamma voltage generator 124, the DAC 126 converts the data signals Data corresponding to a single line, received from the second latch 123, to positive or negative analog video signals. The shift register 121 generates sampling signals using a source shift clock SSC and a source start pulse SSP from a timing controller (not shown). Specifically, the shift register 121 generates sampling signals by shifting the source start pulse SSP in response to the source shift clock SSC and sequentially provides the sampling signals to the first latch 122. The following is a more detailed description of the data driver 120 shown in FIG. 4.

The first latch 122 sequentially samples arranged data signals Data, received from the timing controller through data bus lines, in response to the sampling signals from the shift register 121 and then provides the sampled data signals to the second latch 123.

The second latch 123 stores the sampled data signals received from the first latch 122 on a line by line basis and simultaneously outputs the stored data signals Data, corresponding to a single line, to the DAC 126 in synchronization with the source output enable signal SOE.

The RGB gamma voltage generator 124 generates a plurality of RGB positive gamma voltages (RPgma, RPgma, and RPgma) and a plurality of RGB negative gamma voltages (RNgma, GNgma, and BNgma) at voltage divider nodes between a plurality of resistors connected in series between first and second voltages VH and VL and selectively provides the plurality of RGB positive gamma voltages RPgma, RPgma, and RPgma or the plurality of RGB negative gamma voltages RNgma, GNgma, and BNgma to the DA converter 124 according to the polarity control signal POL. Here, the polarity control signal POL is reversed for each single horizontal line.

Figure 5:
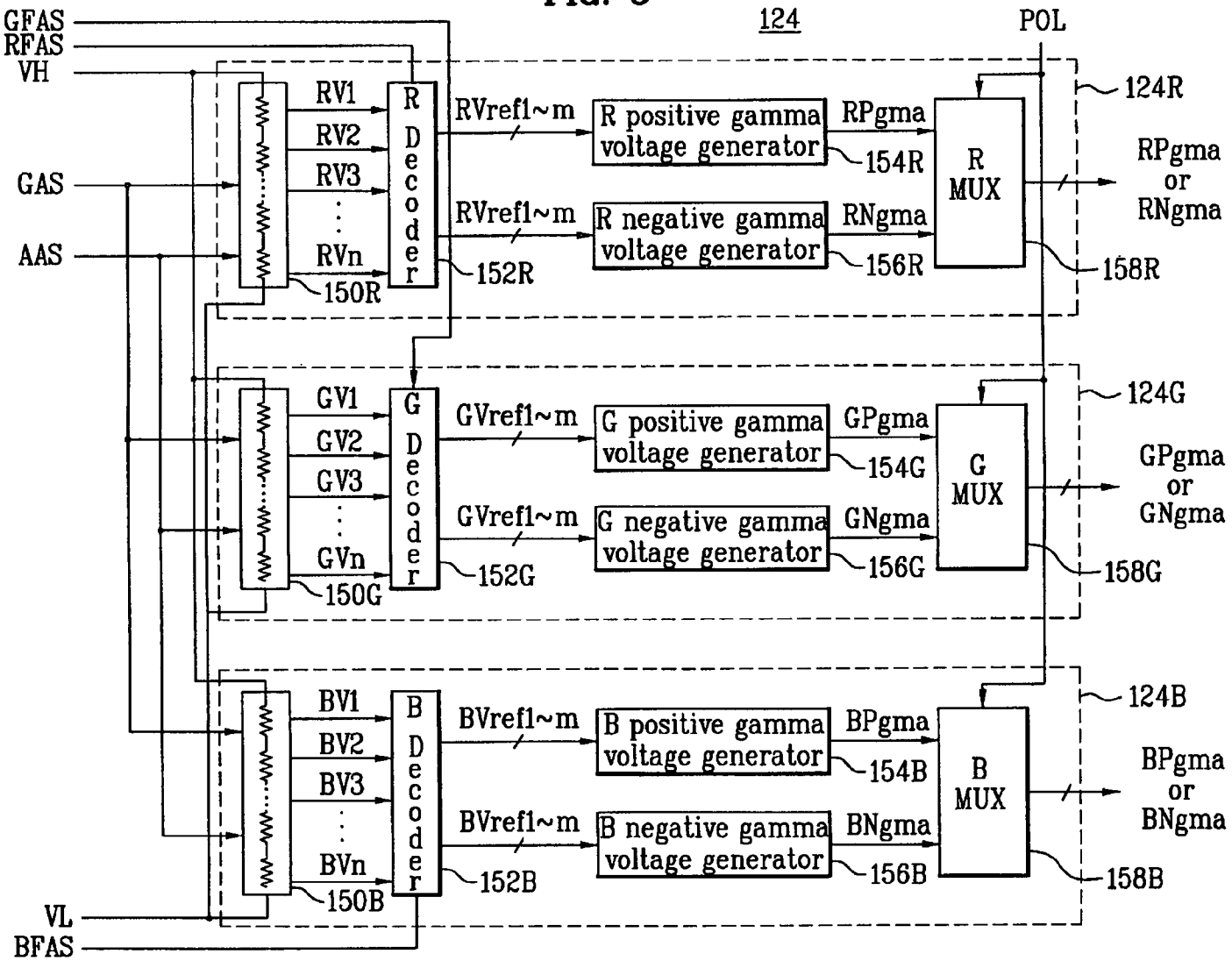
FIG. 5 is a block diagram of the RGB gamma voltage generator shown in FIG. 4.

FIG. 5 is a block diagram of the RGB gamma voltage generator shown in FIG. 4. As shown in FIG. 5, the RGB gamma voltage generator 124 includes a red gamma voltage generator 124R that generates red R positive and negative gamma voltages RPgma and RNgma, a green gamma voltage generator 124G that generates green G positive and negative gamma voltages GPgma and GNgma, and a blue gamma voltage generator 124B that generates blue B positive and negative gamma voltages BPgma and BNgma.

The red gamma voltage generator 124R includes a red resistor set 150R, a red decoder 152R, a red positive gamma voltage generator 154R, a red negative gamma voltage generator 156R, and a red multiplexer 158R.

The red resistor set 150R includes a plurality of red resistors connected in series between the first and second voltages VH and VL and generates n red R divided voltages RV1 to RVn using the red resistors connected in series. The red resistor set 150R provides n different R divided voltages RV1 to RVn, generated at voltage divider nodes between the R resistors through voltage division corresponding to resistances of the resistors, to the red decoder 152R. The red resistor set 150R adjusts the resistances of the red resistors according to a curve adjustment signal GAS and an amplitude adjustment signal AAS received from the outside, thereby adjusting a gamma curve and a gamma voltage amplitude.

The red decoder 152R decodes n red divided voltages RV1 to RVn received from the red resistor set 150R according to a red fine adjustment signal RFAS received from the outside and generates m red reference gamma voltages RVref1 to RVrefm. To accomplish this, the red decoder 152R includes a plurality of decoders that generates m-2 red reference gamma voltages RVref2 to RVrefm-1 except the highest and lowest red reference gamma voltages RVref1 and RVrefm.

The red positive gamma voltage generator 154R further divides m red reference gamma voltages RVref1 to RVrefm received from the red decoder 152R and generates a plurality of red positive gamma voltages RPgma corresponding to gray levels of the data signals Data. The red positive gamma voltage generator 154R provides the red positive gamma voltages RPgma to the red multiplexer 158R.

The red negative gamma voltage generator 156R further divides m red reference gamma voltages RVref1 to RVrefm received from the red decoder 152R and generates a plurality of red negative gamma voltages RNgma corresponding to gray levels of the data signals Data. The red negative gamma voltage generator 156R provides the red negative gamma voltages RNgma to the red multiplexer 158R.

The red multiplexer 158R selectively provides the plurality of red positive gamma voltages RPgma or the plurality of red negative gamma voltages RNgma to the DAC 126 according to the polarity control signal POL. To accomplish this, the red multiplexer 158R includes a plurality of multiplexers (not shown). When the polarity control signal POL is high, the red multiplexer 158R provides the plurality of red positive gamma voltages RPgma to the DAC 126, as shown in FIG. 4. When the polarity control signal POL is low, the red multiplexer 158R provides the plurality of red negative gamma voltages RNgma to the DAC 126.

The green gamma voltage generator 124G includes a green resistor set 150G, a green decoder 152G, a green positive gamma voltage generator 154G, a green negative gamma voltage generator 156G, and a green multiplexer 158G.

The green resistor set 150G includes a plurality of green resistors connected in series between the first and second voltages VH and VL and generates n green G divided voltages GV1 to GVn using the green resistors connected in series. The green resistor set 150G provides n different G divided voltages GV1 to GVn, generated at voltage divider nodes between the G resistors through voltage division corresponding to resistances of the green resistors, to the green decoder 152G. The green resistor set 150G adjusts the resistances of the resistors according to the curve adjustment signal GAS and the amplitude adjustment signal AAS received from the outside, thereby adjusting the gamma curve and the gamma voltage amplitude.

The green decoder 152G decodes n green divided voltages GV1 to GVn received from the green resistor set 150G according to a green fine adjustment signal GFAS received from the outside and generates m green reference gamma voltages GVref1 to GVrefm. To accomplish this, the green decoder 152G includes a plurality of decoders that generates m-2 green reference gamma voltages GVref2 to GVrefm-1 except the highest and lowest green reference gamma voltages GVref1 and GVrefm.

The green positive gamma voltage generator 154G further divides m green reference gamma voltages GVref1 to GVrefm received from the green decoder 152G and generates a plurality of green positive gamma voltages GPgma corresponding to gray levels of the data signals Data. The green positive gamma voltage generator 154G provides the green positive gamma voltages GPgma to the green multiplexer 158G.

The green negative positive gamma voltage generator 156G further divides m green reference gamma voltages GVref1 to GVrefm received from the green decoder 152G and generates a plurality of green negative gamma voltages GNgma corresponding to gray levels of the data signals Data. The green negative gamma voltage generator 156G provides the green negative gamma voltages GNgma to the green multiplexer 158G.

The green multiplexer 158G selectively provides the plurality of green positive gamma voltages GPgma or the plurality of green negative gamma voltages GNgma to the DAC 126 according to the polarity control signal POL. To accomplish this, the green multiplexer 158G includes a plurality of multiplexers (not shown). When the polarity control signal POL is high, the green multiplexer 158G provides the plurality of green positive gamma voltages GPgma to the DAC 126, as shown in FIG. 4. When the polarity control signal POL is low, the green multiplexer 158G provides the plurality of green negative gamma voltages GNgma to the DAC 126.

The blue gamma voltage generator 124B includes a blue resistor set 150B, a blue decoder 152B, a blue positive gamma voltage generator 154B, a blue negative gamma voltage generator 156B, and a blue multiplexer 158B.

The blue resistor set 150B includes a plurality of blue resistors connected in series between the first and second voltages VH and VL and generates n blue B divided voltages BV1 to BVn using the blue resistors connected in series. The blue resistor set 150B provides n different B divided voltages BV1 to BVn, generated at voltage divider nodes between the B resistors through voltage division corresponding to resistances of the resistors, to the blue decoder 152B. The blue resistor set 150B adjusts the resistances of the resistors according to the curve adjustment signal GAS and the amplitude adjustment signal AAS received from the outside, thereby adjusting the gamma curve and the gamma voltage amplitude.

The blue decoder 152B decodes n blue divided voltages BV1 to BVn received from the blue resistor set 150B according to a blue fine adjustment signal BFAS received from the outside and generates m blue reference gamma voltages BVref1 to BVrefm. To accomplish this, the blue decoder 152B includes a plurality of decoders that generates m-2 blue reference gamma voltages BVref2 to BVrefm-1 except the highest and lowest blue reference gamma voltages BVref1 and BVrefm.

The blue positive gamma voltage generator 154B further divides m blue reference gamma voltages BVref1 to BVrefm received from the blue decoder 152B and generates a plurality of blue positive gamma voltages BPgma corresponding to gray levels of the data signals Data. The blue positive gamma voltage generator 154B provides the blue positive gamma voltages BPgma to the blue multiplexer 158B.

The blue negative gamma voltage generator 156B further divides m blue reference gamma voltages BVref1 to BVrefm received from the blue decoder 152B and generates a plurality of blue negative gamma voltages BNgma corresponding to gray levels of the data signals Data. The blue negative gamma voltage generator 156B provides the blue negative gamma voltages BNgma to the blue multiplexer 158B.

The blue multiplexer 158B selectively provides the plurality of blue positive gamma voltages BPgma or the plurality of blue negative gamma voltages BNgma to the DAC 126 according to the polarity control signal POL. To accomplish this, the blue multiplexer 158B includes a plurality of multiplexers (not shown). When the polarity control signal POL is high, the blue multiplexer 158B provides the plurality of blue positive gamma voltages BPgma to the DAC 126, as shown in FIG. 4. When the polarity control signal POL is low, the blue multiplexer 158B provides the plurality of blue negative gamma voltages BNgma to the DAC 126, as shown in FIG. 4.

The DAC 126 converts the data signals Data received from the second latch 123 to positive or negative analog video signals using the plurality of RGB positive gamma voltages (RPgma, GPgma, and BPgma) or RGB negative gamma voltages (RNgma, GNgma, and BNgma) received from the RGB gamma voltage generator 124 according to the polarity control signal POL. The DAC 126 simultaneously outputs the positive or negative analog video signals, corresponding to a single line, to the data lines DL1 to DLm.

When the DAC 126 receives the plurality of R, G, and B positive gamma voltages RPgma, GPgma, and BPgma from the RGB gamma voltage generator 124 according to the polarity control signal POL, the DAC 126 converts the data signals Data, received from the second latch 123, to RGB positive analog video signals using the plurality of R, G, and B positive gamma voltages (RPgma, GPgma, and BPgma). When the DAC 126 receives the plurality of R, G, and B negative gamma voltages (RNgma, GNgma, and BNgma) from the RGB gamma voltage generator 124 according to the polarity control signal POL, the DAC 126 converts the data signals Data, received from the second latch 123, to RGB negative analog video signals using the plurality of R, G, and B negative gamma voltages (RNgma, GNgma, and BNgma). Thus, the data driver 120 according to the embodiment of the present invention converts the digital data signals to analog video signals using individual gamma voltages of red, green, and blue colors. Accordingly, the data driver 120 can adjust individual chromaticity coordinates of red, green, and blue colors through individual gamma voltages of red, green, and blue colors. The data driver 120 according to the embodiment of the present invention can be used to provide analog video signals to small-size liquid crystal displays, such as mobile communication terminals or the like.

As is apparent from the above description, embodiments of the present invention provides a data driver and a liquid crystal display using the same, which converts digital data signals to analog video signals using individual gamma voltages of red, green, and blue colors so that individual chromaticity coordinates of red, green, and blue colors can be adjusted through individual gamma voltages of red, green, and blue colors, and which also minimizes a reduction in the image quality caused by small variations in the common voltage. In addition, since RGB positive or negative gamma voltages are selectively provided to a DAC according to a polarity control signal, the structure of the DAC is simplified and the size thereof is reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A data driver, comprising:

a shift register that generates sampling signals using a shift clock and a start pulse;

a latch that sequentially samples data signals, received from the outside, in response to the sampling signals;

a gamma voltage generator that generates red, green, and blue positive gamma voltages and red, green, and blue negative gamma voltages and selectively outputs the red, green, and blue positive gamma voltages or the red, green, and blue negative gamma voltages according to a polarity control signal; and a digital to analog converter that converts the data signals received from the latch to positive analog video signals using the red, green, and blue positive gamma voltages from the gamma voltage generator if the gamma voltage generator applies the red, green, and blue positive gamma voltages or that converts the data signals received from the latch to negative analog video signals using the red, green, and blue negative gamma voltages from the gamma voltage generator if the gamma voltage generator applies the red, green, and blue negative gamma voltages, wherein the gamma voltage generator includes:

a red gamma voltage generator generating the red positive gamma voltages and the red negative gamma voltages, and selectively outputting the red positive gamma voltages or red negative gamma voltages in response to the polarity control signal;

a green gamma voltage generator generating the green positive gamma voltages and the green negative gamma voltages, and selectively outputting the green positive gamma voltages or green negative gamma voltages in response to the polarity control signal; and a blue gamma voltage generator generating the blue positive gamma voltages and the blue negative gamma voltages, and selectively outputting the blue positive gamma voltages or blue negative gamma voltages in response to the polarity control signal, wherein each of the red, green and blue gamma voltage generators includes:

a single resistor set generating n divided voltages using a plurality of resistors, connected in series between first and second voltages;

a single decoder that decodes the n divided voltages received from the single resistor set and generates m reference gamma voltages according to an adjustment signal;

a positive gamma voltages generator that further divides the m reference gamma voltages received from the decoder and generates a plurality of positive gamma voltages corresponding to gray levels of the data signals;

a negative gamma voltages generator that further divides the m reference gamma voltages received from the decoder and generates a plurality of negative gamma voltages corresponding to the gray levels of the data signals; and a multiplexer that selectively outputs the plurality of red positive gamma voltages or the plurality of red negative gamma voltages to the digital to analog converter in response to the polarity control signal, wherein the single decoder is directly connected with both the positive and negative gamma voltage generators and is directly connected with the single register set, wherein the single decoder is directly connected between an output terminal of the single register set and both input terminals of the positive and negative gamma voltage generators, wherein the single decoder applies the m reference gamma voltages, generated according to the adjustment signal, to the both the positive and negative gamma voltage generators, and wherein the polarity control signal is applied to all the three multiplexers of the red, green and blue gamma voltage generators.

2. A liquid crystal display, comprising:

an image display unit that displays images by controlling light transmittance of liquid crystal cells provided in areas defined by gate and data lines crossing each other;

a gate driver supplying scan pulses to the gate lines;

a data driver supplying positive or negative analog video signals to the data lines; and a timing controller supplying data signals to the data driver and controls drive timings of the data driver and the gate driver, wherein the data driver includes:

a shift register that generates sampling signals using a shift clock and a start pulse;

a latch that sequentially samples the data signals, received from the timing controller, according to the sampling signals;

an gamma voltage generator that generates red, green, and blue positive gamma voltages and red, green, and blue negative gamma voltages and selectively outputs the red, green, and blue positive gamma voltages or red, green, and blue negative gamma voltages according to a polarity control signal; and a digital to analog converter that converts the sampled data signals received from the latch to the positive analog video signals using the red, green, and blue positive gamma voltages from the gamma voltage generator if the gamma voltage generator applies the red, green, and blue positive gamma voltages or that converts the data signals received from the latch to negative analog video signals using the red, green, and the blue negative gamma voltages from the gamma voltage generator if the gamma voltage generator applies the red, green, and blue negative gamma voltages, wherein the gamma voltage generator includes:

a red gamma voltage generator generating the red positive gamma voltages and the red negative gamma voltages, and selectively outputting the red positive gamma voltages or red negative gamma voltages in response to the polarity control signal;

a green gamma voltage generator generating the green positive gamma voltages and the green negative gamma voltages, and selectively outputting the green positive gamma voltages or green negative gamma voltages in response to the polarity control signal; and a blue gamma voltage generator generating the blue positive gamma voltages and the blue negative gamma voltages, and selectively outputting the blue positive gamma voltages or blue negative gamma voltages in response to the polarity control signal, wherein each of the red, green and blue gamma voltage generators includes:

a single resistor set generating n divided voltages using a plurality of resistors, connected in series between first and second voltages;

a single decoder that decodes the n divided voltages received from the single resistor set and generates m reference gamma voltages according to an adjustment signal;

a positive gamma voltages generator that further divides the m reference gamma voltages received from the decoder and generates a plurality of positive gamma voltages corresponding to gray levels of the data signals;

a negative gamma voltages generator that further divides the m reference gamma voltages received from the decoder and generates a plurality of negative gamma voltages corresponding to the gray levels of the data signals; and a multiplexer that selectively outputs the plurality of red positive gamma voltages or the plurality of red negative gamma voltages to the digital to analog converter in response to the polarity control signal, wherein the single decoder is directly connected with both the positive and negative gamma voltage generators and is directly connected with the single register set, wherein the single decoder is directly connected between an output terminal of the single register set and both input terminals of the positive and negative gamma voltage generators, wherein the single decoder applies the m reference gamma voltages, generated according to the adjustment signal, to the both the positive and negative gamma voltage generators, and wherein the polarity control signal is applied to all the three multiplexers of the red, green and blue gamma voltage generators.

* * * * *